US005533673A

United States Patent [19]

Wilson et al.

[11] Patent Number: 5,533,673

[45] Date of Patent: Jul. 9, 1996

[54] NOZZLE SYSTEM IMPARTING COMPOUND MOTION

[75] Inventors: Timothy J. Wilson, Ellicott City; Steven E. Jones, Pasadena, both of Md.

[73] Assignee: Jet Blast Products Corp., Baltimore, Md.

[21] Appl. No.: 332,547

[22] Filed: Oct. 31, 1994

[51] Int. Cl.[6] ..... B05B 3/06

[52] U.S. Cl. ..... 239/227; 239/229

[58] Field of Search ..... 239/229, 226, 239/227, 251, 261

[56] References Cited

U.S. PATENT DOCUMENTS

| | | | |
|---|---|---|---|
| D. 292,133 | 9/1987 | Proctor et al. | D23/225 |
| D. 293,889 | 1/1988 | Proctor | D9/506 |
| D. 297,273 | 8/1988 | Proctor et al. | D32/1 |
| D. 300,453 | 3/1989 | Proctor et al. | D23/226 |
| D. 310,405 | 9/1990 | Proctor et al. | D23/226 |
| 1,546,714 | 7/1925 | Buzbee | 239/229 |
| 2,417,222 | 3/1947 | Stine | 239/229 |
| 2,758,874 | 8/1956 | Snyder | 239/229 |
| 3,653,598 | 4/1972 | Waldrum | 239/229 |
| 4,044,953 | 8/1977 | Vogel | 239/229 |
| 4,369,850 | 1/1983 | Barker | 239/229 X |
| 4,372,493 | 2/1983 | Smith | 239/229 X |
| 4,682,734 | 7/1987 | Proctor et al. | 239/315 |
| 4,716,604 | 1/1988 | Watkins | 239/229 X |
| 4,795,094 | 1/1989 | Correard | 239/229 |
| 4,858,830 | 8/1989 | Proctor et al. | 239/313 |
| 4,886,212 | 12/1989 | Proctor et al. | 239/315 |

FOREIGN PATENT DOCUMENTS 1806634 11/1968 Germany .

*Primary Examiner*—Andres Kashnikow
*Assistant Examiner*—Lesley D. Morris
*Attorney, Agent, or Firm*—Banner & Allegretti, Ltd.

[57] ABSTRACT

A nozzle system for imparting compound motion, including an orbital component and a rotational component, to the discharged fluid. The nozzle system comprises a specially engineered shell surrounding a freely flexible hose of sufficient structural integrity to simultaneously exhibit two different motion characteristics to impart the compound motion to the discharged fluid. When fluid is delivered to the nozzle system, the hose moves orbitally; that is, the hose rides against the wall of the shell in a cork screwing manner. Simultaneously, the hose rotates or twists back and forth about its own axis relative to its fixed end. Both components of motion are imparted to the discharged fluid to enhance spray power and expanse.

8 Claims, 2 Drawing Sheets

NOZZLE SYSTEM IMPARTING COMPOUND MOTION

FIELD OF THE INVENTION

The present invention pertains to a nozzle system for discharging a high impact jet of fluid for improved cleaning capabilities.

BACKGROUND OF THE INVENTION

Nozzles which discharge fluids at high speeds have generally used a constricted orifice to increase the pressure and thereby achieve a relatively high discharge velocity. The constriction may also provide a more expansive spray pattern. Fluid streams or jets which are discharged at higher speeds travel longer paths or provide more impact to a target surface.

The prior art spray devices include those having freely flexible rubber hoses or tubes which whip or oscillate in a swinging manner upon discharge of a fluid under pressure to provide expanded spray coverage. An example of such is disclosed in U.S. Pat. No. 2,758,874 to Snyder. Other prior art devices encase such hoses or tubes within guards as disclosed in U.S. Pat. No. 2,417,222 Stine; U.S. Pat. No. 4,044,953 to Vogel and German Patent No. 1,806,634 to Heyne. Still other prior art devices include additive fluid feed devices for mixing detergent into the discharged fluid, and spray selectors for producing varying spray speeds and patterns as disclosed in U.S. Pat. Nos. 4,682,734, 4,858,830 and 4,886,212 to Proctor et al. In a spray device manufactured by Turbo Tek International of Los Angeles, Calif. and referred to as the "Turbo-Wash Pulsator", a rotating nozzle body housing an internal gear mechanism discharges water with a spinning action.

Prior devices have not been able to adequately supply a high impact jet of fluid to a target surface with a consistent, definitive pattern of motion to enhance cleaning effectiveness while maintaining a simple, efficient construction. Instead, in the prior art, the nozzle devices have imparted an erratic whipping or swinging motion for the primary purpose of increasing the expanse of the spray area.

SUMMARY OF THE INVENTION

The present invention pertains to a nozzle system for imparting a compound motion to the discharged fluid. Specifically, the nozzle system comprises a shell surrounding a flexible hose which cooperates to discharge the fluid with an orbital component and a rotational component of motion.

In accordance with the present invention, the proximal end of the hose is attached to a nozzle mounted at the base of the shell for delivering the fluid under pressure. The distal end of the hose extends outward from the nozzle for free movement within the shell. When fluid is discharged, the nozzle system develops an orbital and rotational jet spray of fluid. The shell is shaped to guide the hose in a cork screwing action to produce an orbital discharge of fluid; that is, the hose rides against the shell interior so that fluid exiting its free end is moving in an orbital pattern. The hose is made of a material which exhibits an ideal balance of flexibility and strength to provide the desired motion and withstand the pressurized fluid. In operation, the hose travels in a circular path along the shell interior. The lateral movement of the hose against the shell causes the hose to rotate in one direction about its own axis until a twisting limit is reached and the hose rotation reverses direction. The hose will reverse its rotation back and forth during the spraying operation.

These and other objects, advantages, and features of the present invention will be more fully understood and appreciated by reference to the written specification and appended drawings.

DETAILED DESCRIPTION OF THE PREFERRED EMBODIMENTS

Figure 1:
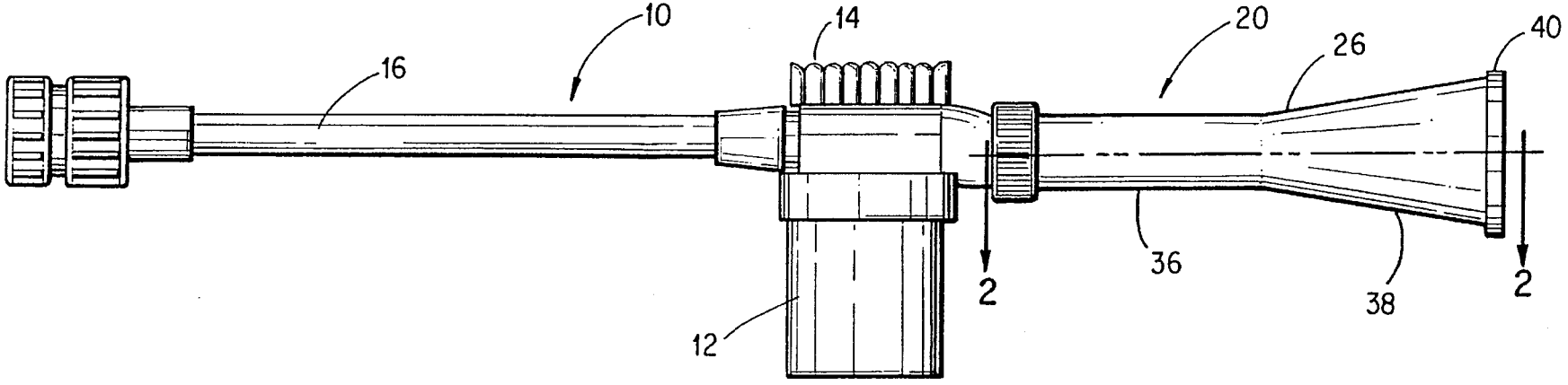
FIG. 1 is a side elevational view of the nozzle system of the present invention attached to a control and dispensing device.
Figure 2:
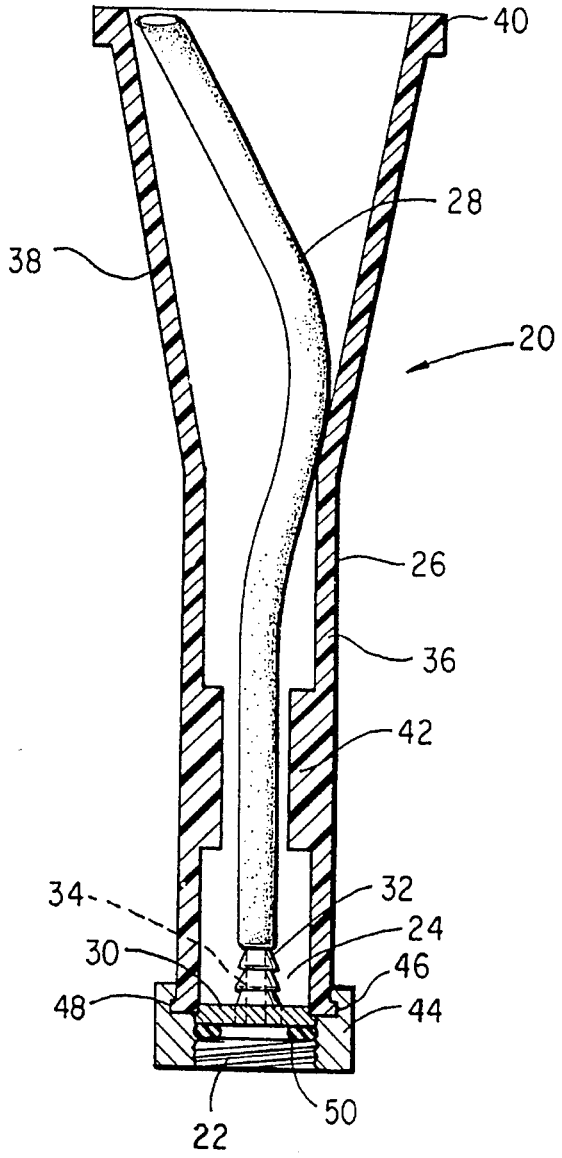
FIG. 2 is a cross sectional view of the nozzle system taken along line 2—2 of FIG. 1.

In the preferred embodiment, nozzle system 20 is attachable to a variety of fluid delivery devices such as a washing device 10 (FIG. 1). Washing device 10 may include a detergent reservoir 12, wash/rinse control 14 and an extension 16. Of course, a wide variety of fluid delivery devices could be used. Nozzle system 20 comprises a nozzle 24 disposed near connector 22, a flexible hose 28, and a containment shell 26 which surrounds the hose (FIG. 2).

Nozzle 24 preferably includes a seat 30 and a forwardly projecting barbed tip 32 both preferably formed of a metallic or other generally rigid material. The nozzle defines a constricted orifice 34 through which the fluid is discharged under pressure. Nozzle seat 30 is disposed in an annular fitting 44. The seat is placed in abutment against an internal shoulder in fitting 44 or secured by other means such as welding, soldering or the like. The other end of fitting 44 is adapted to receive a fluid delivery device. In the preferred construction, the fitting defines a female threaded connector 22 of a standard ¾ inch size for use with an ordinary garden hose. The threaded connector 22 may, however, be sized as needed for other end uses. The assembly further includes a washer 50 to seal the connection to prevent leakage.

Containment shell 26 includes a substantially linear section 36 proximate nozzle 24 and attached to fitting 44, and a flared section 38. The flared section has a generally circular conical configuration such that a frusto-conical cavity is defined therein. Preferably the shell of the flared section diverges from the linear section at an angle of approximately 10°. Variations from the preferred angle may be used so long as the corkscrew motion of the hose is maintained. The free end of flared section 38 preferably includes a rim 40 for greater strength. The proximate end of the shell is shaped to fit into fitting 44. Preferably, shell 26 includes a lip 48 received within a recess 46 to secure the shell in place. Nonetheless, other types of attachment may be used. Linear section 36 further includes a reduced diameter portion 42 in order to better control the hose as will be explained later. For molding purposes (the preferred manufacturing process) the linear portion is tapered slightly with respect to the central axis, on the order of approximately 10°.

Hose 28 must be made of a material which is flexible, durable, and resilient under torsion. The preferred material for hose 28 is silicone tubing having a 70 durometer hardness level. The material integrity of hose 28 is important to the proper operation of nozzle system 20. Orifice 34 of base nozzle 24 has a smaller diameter than the internal diameter of fitting 44 to increase the pressure of the fluid. When a fluid under pressure is delivered to nozzle system 20 through orifice 34, the constriction develops a higher velocity in the fluid as it discharges through tip 32. The hose must be strong enough to withstand the pressure and flexible enough to create the desired fluid pattern.

Other hose materials have been tested in the present system and have been found lacking. Rubber hoses, for instance, tend to change consistency due to changes in temperature and pressure, and are not satisfactory for use in the present system. Moreover, stiffer materials, such as rubber, do not exhibit the needed flexibility to achieve the desired motion characteristics. Some materials which are sufficiently flexible do not have the necessary strength to withstand the pressure of the discharged fluid, and fail.

The proximal end of hose 28 is securely attached to nozzle 24, while the other end is free. In the preferred embodiment, hose 28 is fitted onto barbed tip 34 of base nozzle 24. The resilience of the hose secures the connection by a combination of an interference fit and engagement of the barbs. Although this is the preferred method of connection, any known method can be used to secure hose 28 to base nozzle 24.

When the fluid is discharged through hose 28, the hose is driven against the wall of the shell. Due to the linear portion and especially the reduced diameter portion and the nature of the silicone hose, the hose rides along the circular internal wall of shell 26. In the preferred construction, the reduced diameter portion has a ⅜ inch diameter, and the hose has an external diameter of 9/32 inch and an internal diameter of 5/32 inch. The remaining linear portion has a ⅝ inch diameter. The reduced diameter portion 42 of linear section 36 forms an annular shoulder for the hose. The reduced diameter portion defines a pivot point for the hose's orbital movement since this component of motion occurs largely in flared section 38 of shell 26. It has been found that a reduced diameter portion in the linear section is necessary to control movement of hose 28. A reduced diameter portion which extends too far into the flared section may cause the hose to bind. In the preferred construction, the reduced diameter shoulder is spaced approximately 1⅓ inches from the base of the flared section. The hose assumes a "corkscrew" shape to form a uniform orbital jet spray. The orbital movement of hose 28 in shell 26 imparts an orbital component of motion to the discharged fluid. The resulting discharging fluid jet may move orbitally at up to 70 feet per second.

Figure 3:
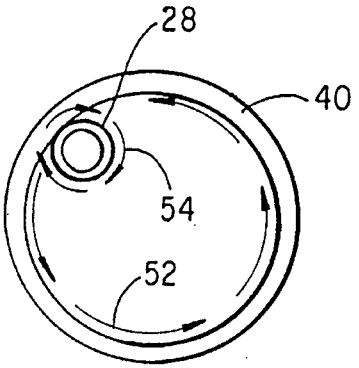
FIG. 3 is a schematic diagram of the open end of the nozzle system of FIG. 1 showing the motion characteristics of a discharged fluid.

As hose 28 moves in the circular, corkscrew pattern, it also rotates or spins about its own axis. A schematic representation of the movement of hose 28 within shell 26 as viewed from the open end of shell 26 is shown in FIG. 3. Hose 28 moves in a circular or orbital path against shell 26 as indicated by arrows 52. At the same time, due to frictional forces along shell 26, hose 28 rotates or spins about its own axis as indicated by arrows 54. The rotational motion of hose 28 is limited by its fixed connection to nozzle 24 such that when hose 28 has rotated as far as possible in one direction, that is, reached its maximum degree of twist, its torsional resilience causes it to reverse direction. Once the hose has unwound to a certain degree, its movement along the shell will cause it to once again rotate in the direction of arrows 54. The exact extent of rotation will depend upon a variety of factors such as the length of the hose, the shape of the shell, the delivery pressure of the fluid, etc. This rotation and reverse rotation of hose 28 occurs cyclicly to impart a rotational component of motion to the discharged fluid. The rotation of hose 28 may be up to 1500 rpm. Both movements of hose 28 within shell 26 during operation are controlled and consistent.

The relatively simple construction of nozzle system 20 has economic advantages due both to material savings and simplified manufacture compared to prior art devices. In addition, the construction is specifically designed to minimize mechanical loss of the fluid under pressure.

A particular application of nozzle system 20 is for cleaning surfaces. Nozzle system 20 is preferably designed to develop the compound motion jet spray using only water pressure in the range of 20 to 80 PSI—a pressure range found in most residences. Nozzle system 20 discharges water with a high velocity and compound motion. The consistent, regular orbital component of motion of the discharged water impacts the target surface forming a high frequency vibration in a thin layer of water on the surface. This vibration greatly enhances the cleaning effectiveness of the jet spray by loosening dirt and other particles. In addition, the orbital and rotational motions of the discharged water further provide a lateral movement of water when it strikes the target surface. This lateral movement enhances the cleaning action by providing a shearing force to the target surface. This can be described as a centrifugal shearing action which aids in quickly dispersing dirt from the target surface.

Flared section 38 of shell 26, also provides a wide cleaning path or spray area for more efficiency. Washing device 10 (FIG. 1) is shown with detergent reservoir 12 which allows the addition of cleaning agents in the jet spray for even more efficient cleaning action. Nozzle system 20 may be attached to an extension similar to extension piece 16, and may be used with or without a detergent dispenser.

The above description is that of a preferred embodiment of the invention. Various alterations and changes can be made without departing from the spirit and broader aspects of the invention as set forth in the appended claims.

We claim:

1. A nozzle system comprising:

a nozzle for receiving a fluid;

a flexible hose connected to said nozzle and in fluid communication therewith; and a shell having an interior surface, said shell surrounding said nozzle and said hose and having a substantially linear portion and a flared portion, said hose engaging said interior surface of said shell during discharge of the fluid such that said hose moves along said interior surface in an orbital path whereby the fluid is discharged with an orbital motion:

wherein said hose is fixedly connected to said nozzle such that said hose rotates about its own longitudinal axis as it moves along said interior surface of said shell.

2. The nozzle system of claim 1 wherein said linear portion of said shell includes a reduced diameter portion which provides an annular shoulder about which said hose turns as said hose moves along said orbital path.

3. The nozzle system of claim 1 wherein said hose is made of silicone.

4. The nozzle system of claim 1 wherein said nozzle comprises a substantially rigid tip having barbs for holding said hose.

5. A nozzle system comprising:

a nozzle having an orifice for receiving fluid therethrough;

a hollow shell having an interior surface including a generally linear portion adjacent said nozzle and a flared portion remote from said nozzle; and a resilient hose attached to said nozzle and extending into said flared section of said shell, said hose having a conduit in fluid communication with said orifice of said nozzle for receiving and discharging the fluid, said hose engaging said interior surface of said shell during discharging of said fluid so that said hose moves along said interior surface in an orbital motion and rotates about its own longitudinal axis, whereby said fluid is discharged with an orbital and rotational compound motion.

6. The nozzle in accordance with claim 5 in which said linear portion and said flared portion have generally the same length.

7. The nozzle in accordance with claim 5 in which said linear portion includes a first portion having a first diameter and a second portion having a second diameter, said second diameter being less than said first diameter to closely but loosely receive said hose therein.

8. The nozzle in accordance with claim 5 in which said hose is composed of silicone.

* * * * *